US007532918B2

(12) United States Patent
Cao et al.

(10) Patent No.: US 7,532,918 B2
(45) Date of Patent: May 12, 2009

(54) SUPERCONDUCTIVE FILTER HAVING U-TYPE MICROSTRIP RESONATORS WITH LONGER AND SHORTER PARALLEL SIDES

(75) Inventors: Bisong Cao, Beijing (CN); Meihong Zhu, Beijing (CN); Xubo Guo, Beijing (CN); Guyoyong Zhang, Beijing (CN); Shan He, Beijing (CN); Irana B. Vendik, St. Petersburg (RU); Yaroslav Kolmakov, St. Petersburg (RU)

(73) Assignee: Tsinghua University, Beijing (CN)

( * ) Notice: Subject to any disclaimer, the term of this patent is extended or adjusted under 35 U.S.C. 154(b) by 240 days.

(21) Appl. No.: 10/540,332

(22) PCT Filed: Dec. 18, 2003

(86) PCT No.: PCT/CN03/01082

§ 371 (c)(1),
(2), (4) Date: Jun. 30, 2006

(87) PCT Pub. No.: WO2004/075338

PCT Pub. Date: Sep. 2, 2004

(65) Prior Publication Data

US 2006/0276343 A1 Dec. 7, 2006

(30) Foreign Application Priority Data

Dec. 20, 2002 (CN) ..... 02 1 56889

(51) Int. Cl.
*H01P 1/203* (2006.01)
*H01B 12/02* (2006.01)

(52) U.S. Cl. ..... 505/210; 333/99 S; 333/204

(58) Field of Classification Search ..... 333/99 S, 333/204, 219; 505/210
See application file for complete search history.

(56) References Cited

U.S. PATENT DOCUMENTS 4,918,050 A * 4/1990 Dworsky ..... 505/210

(Continued)

FOREIGN PATENT DOCUMENTS

JP 405299914 A * 11/1993

OTHER PUBLICATIONS

Mansour, Raafat; "Design of Superconductive Multiplexers Using Single Mode and Dual Mode Filters"; IEEE Transactions on Microwave Theory and Techniques; vol. 42, No. 7, Part 2; Jul. 1994.*

*Primary Examiner*—Benny T. Lee
(74) *Attorney, Agent, or Firm*—Perkins Coie LLP

(57) ABSTRACT

The present invention discloses a U-type superconductive microstrip resonator and a filter corresponding to the same. The U-type superconductive microstrip resonator is an asymmetric U-type configuration formed by folding the superconductive microstrip, its total length is a half of the wavelength corresponding to the center frequency of the filter constituted by them. A filter can be constituted by a number of said U-type superconductive microstrip resonators as required. In this filter, these U-type microstrip resonators are arranged in parallel in a manner that the longer sides direct a same direction, or in a manner that every two adjacent U-type superconductive microstrip resonators are symmetric about an axis. The filter constituted by said U-type superconductive microstrip resonators can not only achieve the same specification as an open-loop superconductive microstrip filter with a same number off sections, but also achieve a smaller size than the open-loop superconductive microstrip filter.

9 Claims, 6 Drawing Sheets

U.S. PATENT DOCUMENTS 5,055,809 A * 10/1991 Sagawa et al. ..... 333/219
5,519,366 A * 5/1996 Kaneko et al. ..... 333/204
5,616,538 A * 4/1997 Hey-Shipton et al. ..... 505/210
6,496,710 B1 * 12/2002 Tsuzuki ..... 505/210

* cited by examiner

SUPERCONDUCTIVE FILTER HAVING U-TYPE MICROSTRIP RESONATORS WITH LONGER AND SHORTER PARALLEL SIDES

FIELD OF THE INVENTION

The present invention relates to microwave filter, and in particular, to a superconductive microstrip resonator and filter.

BACKGROUND OF THE INVENTION

Filters are important Microwave components required to transmit signals within a desired frequency band and to filter out signals beyond the desired frequency band. Generally a frequency band within which signals can pass through a filter is called the pass-band, and a frequency band within which signals are filtered out by the filter is called the cut-off region. An ideal filter can transmit signals in a pass-band without attenuation, and cause signals in the cut-off region to attenuate infinitely. To achieve the above effect, the transition between pass-band and cut-off region should be as steep as possible, namely the pass-band edges should be as steep as it could be. Commonly, poles of the filter (the amount of resonator) can be added to increase the steepness of the pass-band edges, but this will bring distinct insertion losses, causing the attenuation of the pass-band to become larger and exacerbating the performance of the filter. So a normal microstrip filter with more poles has a larger insertion loss, which is difficult to meet the needs in the fields of high standard requirements, such as satellite applications. In this instance only waveguide filter can be applied to achieve the requirements.

Recently, with the development of techniques of preparation for HTS (high temperature superconductive) materials, including preparation for single crystal and thin film etc, it is possible for superconductive microstrip to be used in practical applications. Comparing with common microstrip filters, a superconductive microstrip filter has lower insertion loss, better anti-interference ability against neighbor frequency, higher Q value of the resonator (below 10 GHz, Q value is about 40,000-100,000). Experiment results show that a superconductive microstrip filter has steeper band-edges, extremely low insertion loss and flat pass-band characteristic, which is close to the ideal filter in performance. A superconductive microstrip filter also has the merit of smaller volume and lighter weight as compared with common microstrip filter. With the above characteristics, superconductive microstrip filters, instead of wave-guide filters, shall be employed in fields having higher requirements for filters.

FIG. 1 shows an superconductive microstrip filter invented in England in 2000, which comprises 8 open-loop form resonators in the same or similar size, having a substrate of LaAIO.sub.3, wherein the total length of the filter is 39 mm and the total width of the filter is 23.5 mm. As shown in FIG. 1, in this superconductive microstrip filter, resonator 1, 2, 3, 4, 5, 6, 7, and 8 are disturbed in an axis symmetric configuration, the intervals between the resonators are determined by requirements for the performance of the microstrip filter. Each resonator is made of an superconductive microstrip line which is folded like a ring structure with a gap of width Wg, the total length of the ring structure microstrip line is about a half of the wavelength corresponding to the center frequency of superconductive microstrip filter. Here, the electric field is mostly concentrated at the gap of the ring structure, so this part of the resonator is like a capacitance; the magnetic field is mostly disturbed on the other side of the resonator opposite to the gap, so the superconductive microstrip line functions similarly to an inductance. The width WO of the input feed-line 1 and output feed-line 12 corresponds to 50.OMEGA. of input impedance and output impedance. Because the lengths of the input feed-line 11 and output feed-line 12 have no influence on the filter performance, the respective lengths could be several millimeters in accordance with technique requirements. The positions at which the input feed-line 11 and output feed-line 12 are connected to neighboring resonator 1 and 8 are determined by input and output impedance matching.

FIG. 2 shows the frequency response of the superconductive microstrip filter in FIG. 1 at 55K when combined with a LNA (low noise amplifier). In FIG. 2, solid line 21 indicates the characteristic curve of transmission loss of the superconductive microstrip filter, dash line 22 represents characteristic curve of reflect loss of the superconductive microstrip filter. In FIG. 2, the X-axis "Frequency (MHz)" denotes the frequency of the signals in mega-Hertz. S11 and S21 denote the transmission loss values of 21 and 22. It can be seen from the figure, the insertion loss of the filter is about 0.13 dB at pass-band, the steepness of the low band-edge is 20 dB/MHz, the steepness of the high band-edge is 15 dB/MHz. While this type of superconductive microstrip filter has high Q value, low insertion loss and good band-edge steepness, the resonators constituting the superconductive microstrip filter are too large to effectively use a substrate space, therefore the poles of the filter can not be increased by increasing the number of the resonators, whereas increasing the number of the resonators can substantially improve the steepness. Hence, the above described structure is not satisfying In order to overcome shortages of the existing techniques, it is necessary to advance a resonator of smaller dimension to increase the number of resonators within the limited substrate space of a superconductive microstrip filter.

SUMMARY OF THE INVENTION

One object of the invention is to provide a type of superconductive microstrip resonator which is smaller than an open-loop resonator.

Another object of the invention is to provide a superconductive microstrip filter comprising a plurality of resonators which are smaller than open-loop resonators, so that the superconductive microstrip filter of the present invention has the characteristics of low insertion loss, high rejection beyond the pass-band and steep band-edge, as well as merits of compact structure and smaller size.

In order to realize the objects of the invention, there is provided a U-type superconductive microstrip resonator according to the present invention, characterized in that said superconductive microstrip resonator has a U-type structure formed by folding a superconductive microstrip line.

A type of superconductive microstrip filter according to the present invention, includes:

an input coupling line, for receiving signals to be filtered and outputting the signals in the manner of coupling;

a plurality of U-type superconductive microstrip resonators of the same structure and dimension, for performing filtering process for the signals received from the input coupling line to obtain signals in corresponding frequency band and then outputting the obtained signals in the manner of coupling;

an output coupling line, for outputting signals outputted by said U-type superconductive microstrip resonators in the manner of coupling.

DETAILED DESCRIPTION OF THE INVENTION

Now U-type superconductive microstrip resonators and corresponding U-type superconductive microstrip filters according to the present invention will be described in detail in conjunction with accompanying figures.

Figure 1:
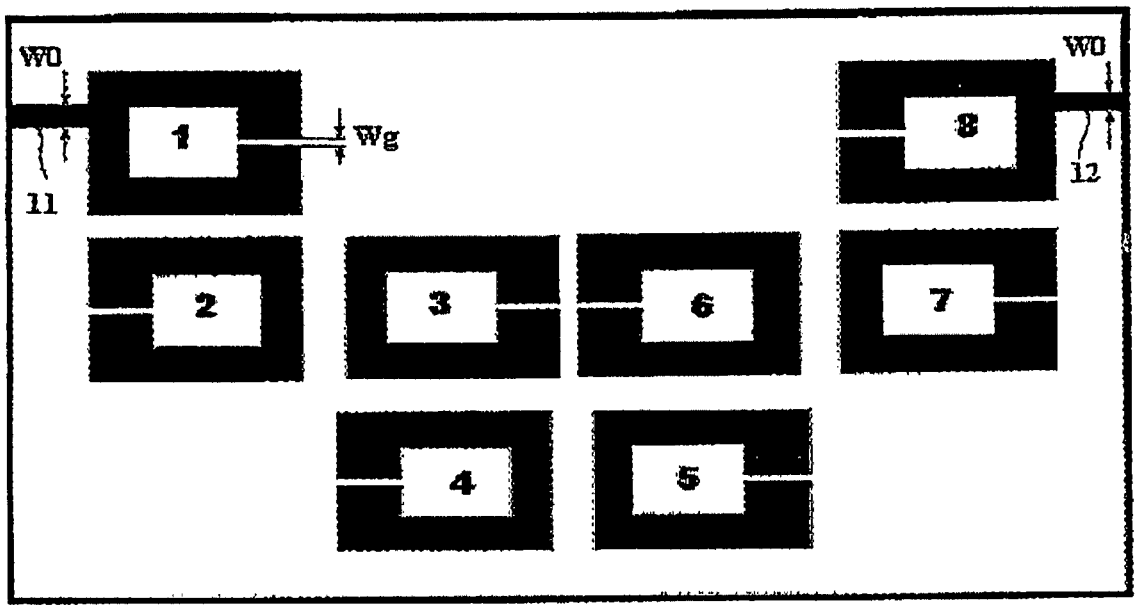
FIG. 1 PRIOR ART
FIG. 1 shows a simplified view of the configuration of a prior art superconductive microstrip filter comprising 8 open-loop resonators.
Figure 2:
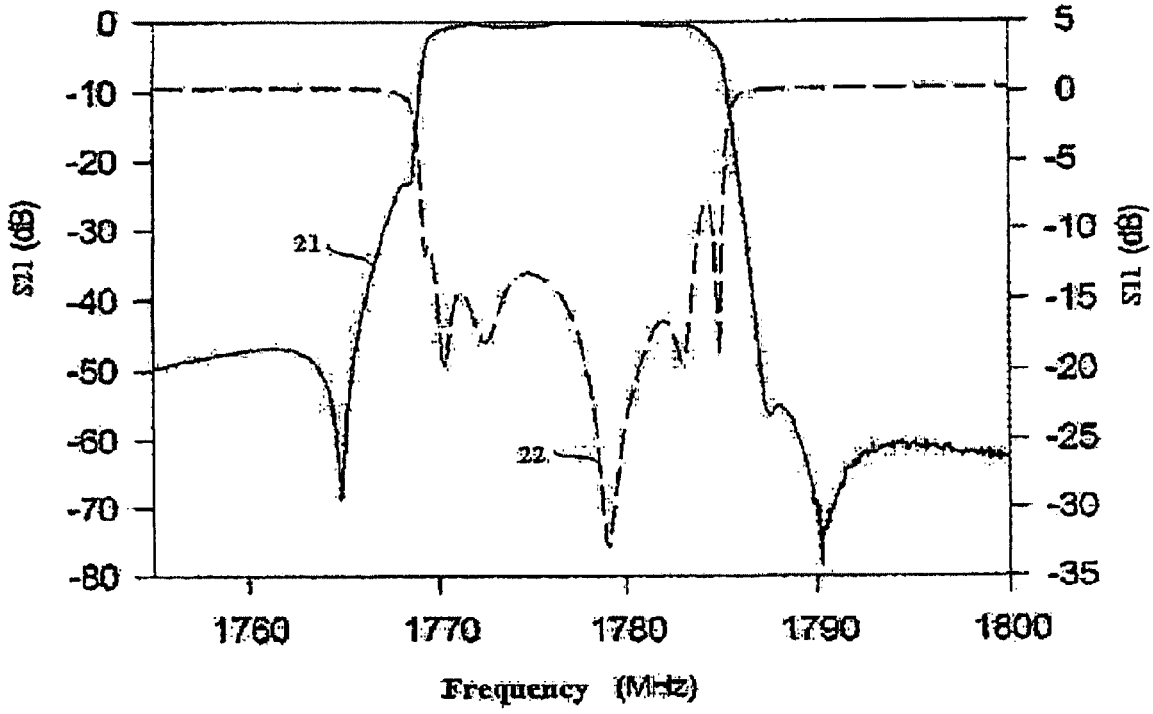
FIG. 2 PRIOR ART
FIG. 2 is a response curve of the prior art superconductive microstrip filter shown in FIG 1.
Figure 3:
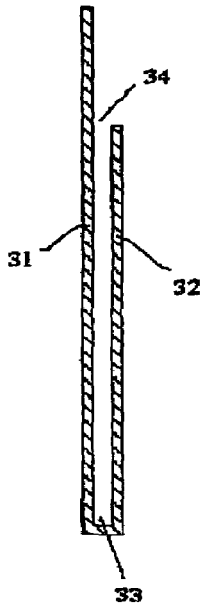
FIG. 3 shows a simplified view of the configuration of one U-type superconductive microstrip resonator of the present invention.

FIG. 3 shows a simplified view of a U-type superconductive microstrip resonator of the present invention. As shown in the figure, the U-type superconductive microstrip resonator has a U-type structure formed by folding a superconductive microstrip line. Here, the whole length of the superconductive microstrip line bent to U-type is as long as a half of the wavelength corresponding to the center frequency of a superconductive microstrip filter formed with the U-type resonators. In this U-type structure, 33 denotes the blind end and 34 denotes the open end. 31 and 32 represent superconductive microstrip lines on both sides of the open end 34 respectively, which are in different length. The respective lengths of superconductive microstrip lines 31 and 34 on both sides of the open end 34 and the distance between them are determined in accordance with particular requirements for designing the superconductive microstrip filter comprising the U-type superconductive microstrip resonators.

Figure 4:
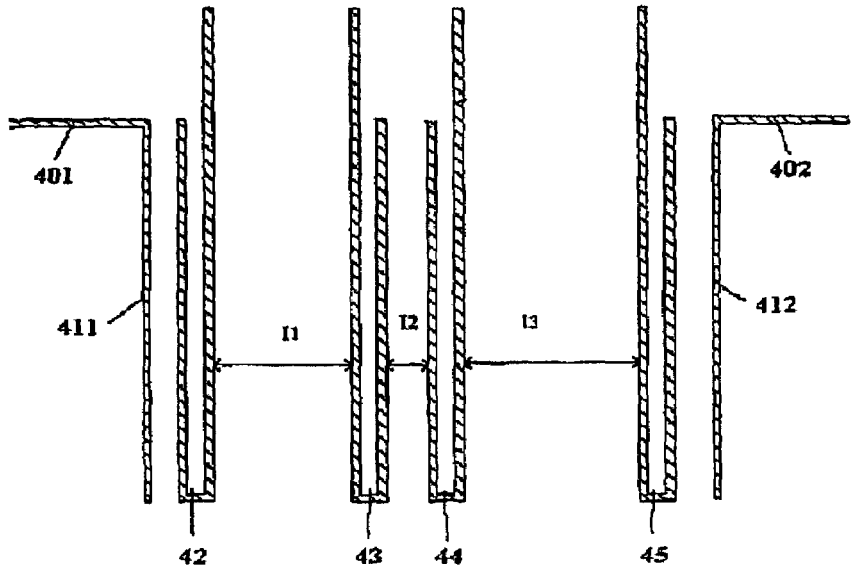
FIG. 4 shows a simplified view of the configuration of one superconductive microstrip filter comprising 4 U-type superconductive microstrip resonators according to the present invention.

FIG. 4 shows a simplified view of the configuration of a superconductive microstrip filter comprising 4 U-type superconductive microstrip resonators of the present invention. As the material of the substrate of the filter (not shown in FIG. 4), $LaAlO_3$, MgO and Sapphire etc. could be used. As shown in FIG. 4, an input feed-line 401 of the superconductive microstrip filter receives signals to be filtered and transmits them to an input coupling line 411. The input coupling line 411 then couples the signals received from the input feed-line 401 to the array of resonators comprising 4 U-type superconductive microstrip resonators 42, 43, 44 and 45 which are in the same dimension and structure.

After receiving signals from the input coupling line 411, the array of resonators filters the signals to obtain signals in corresponding frequency band, and couples the resultant signals to output coupling line 412. The U-type superconductive microstrip resonators 42, 43, 44 and 45 are arranged in parallel with each other from left to right in this order. Here, the U- type superconductive microstrip resonators 42 and 43 are arranged in parallel and are axis symmetric with respect to each other, and their longer sides at the open end are closer to the axis of symmetry than the shorter ones respectively. The U-type superconductive microstrip resonators 44 and 45 are in the same arrangement as the resonators 42 and 43. The intervals 11, 12 and 13 between U-type superconductive microstrip resonators 42 and 43, 43 and 44, 44 and 45 respectively are determined in accordance with particular requirements for designing the superconductive microstrip filters. At the open end of the U-type superconductive microstrip resonator 42 which is adjacent to the input coupling line 411, the top end of the left side of the U-type resonator 42 is aligned with the input coupling line 411. The same is true for the top end of the right side of the U-type resonator 45 and the output coupling line 412.

After receiving the signals from the array of resonators, the output coupling line 412 outputs the signals to the input feed-line 402, then the input feed-line 402 sends the signals to a corresponding processing module.

The above description has been directed to the superconductive microstrip filter of the present invention comprising 4 U-type superconductive microstrip resonators. As for the U-type superconductive microstrip resonators 42 and 43, it can also be arranged to make the shorter sides of their open ends are closer to the axis of symmetry than the longer ones respectively, and the same is true for the U-type superconductive microstrip resonators 44 and 45.

Under the principle for designing a superconductive microstrip filter as mentioned above, more U-type superconductive microstrip resonators can be applied to a filter to obtain a superconductive microstrip filter with more poles on request.

Figure 5:
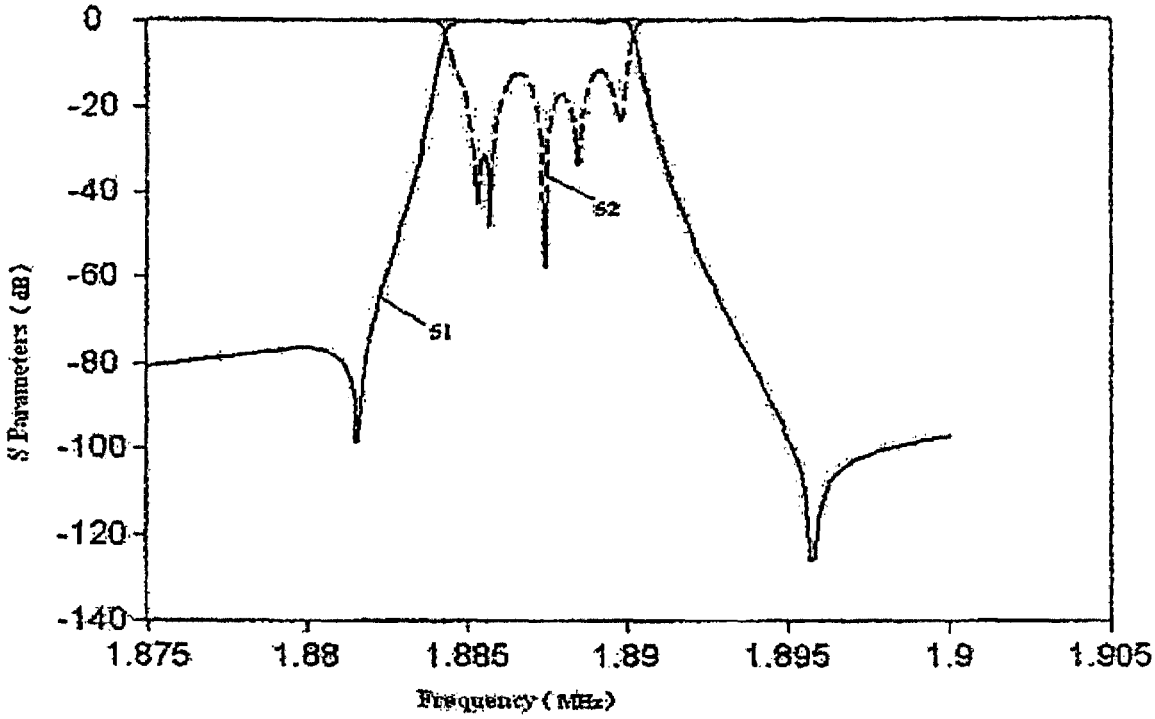
FIG. 5 is a response curve of the superconductive microstrip filter shown in FIG. 4.

FIG. 5 shows a response curve of the superconductive microstrip filter shown in FIG. 4. As shown in FIG. 5, the solid curve 51 represents the transmission loss of the superconductive microstrip filter, and the broken curve 52 denotes the reflection loss of the superconductive microstrip filter. In FIG. 5. the X-axis "Frequency (MHz)" denotes the frequency of the signals in mega-Hertz. The Y-axis "S Parameters" denotes the signal loss value of the microstrip filter. It can be seen from FIG. 5, the insertion loss of the superconductive microstrip filter's pass band is 0.3 dB, and the band-edge steepness is 35 dB/MHz in low-frequency side and 30 dB/MHz in high-frequency side. With the increase of the poles of the filter, the band-edge steepness of the superconductive microstrip filter can be greater, then rejection beyond the pass-band will be higher.

Figure 6:
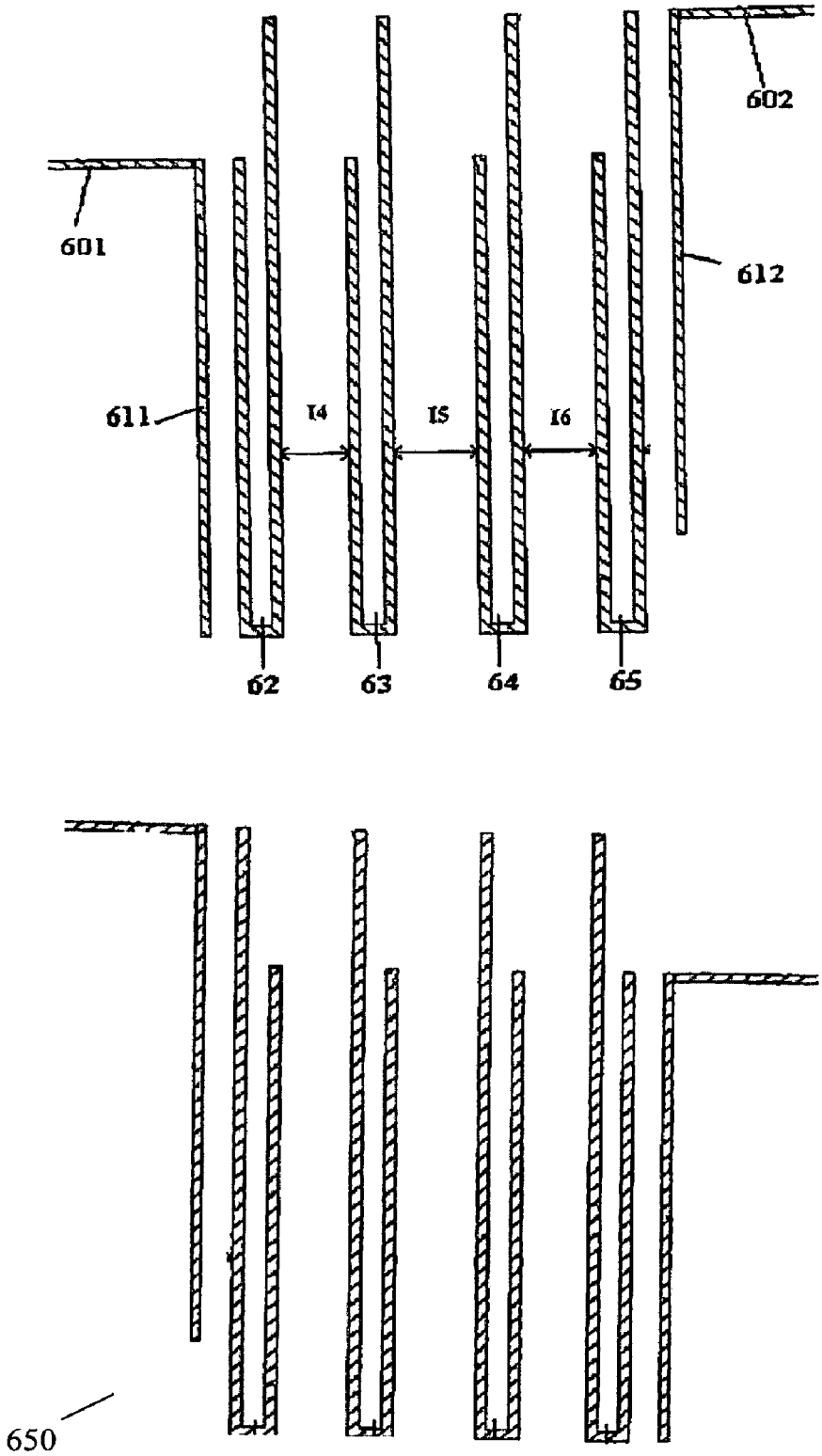
FIG. 6 shows a simplified view of the configuration of another superconductive microstrip filter comprising 4 U-type superconductive microstrip resonators according to the present invention.

FIG. 6 shows a simplified view of the configuration of another superconductive microstrip filter comprising 4 U-type superconductive microstrip resonators of the present invention, as the material of the substrate of the filter (not shown in FIG. 6), $LaAlO_3$, MgO and Sapphire etc. may be used. As shown in FIG. 6, an input feed-line 601 of the superconductive microstrip filter receives signals to be filtered and send them to a input coupling line 611. The input coupling line 611 then sends the received signals to the array of resonators comprising 4 U-type superconductive microstrip resonators 62, 63, 64 and 65 which are in the same dimension and structure. FIG. 6 also shows another embodiment 650 of the superconductive microstrip resonators, where the longer arm is closer to an axisymmetrical point of the orientation.

After receiving signals from input coupling line 611, the array of resonators filters the signals to obtain signals in corresponding frequency band, then transmits them to a output coupling line 612. The U-type microstrip resonators 62, 63, 64 and 65 are arranged in parallel from left to right in this order. All the longer sides of the open ends of the U-type superconductive microstrip resonators are arranged on the same sides of respective filters. The intervals I4, I5 and I6 between U-type superconductive microstrip resonators 62 and 63, 63 and 64, 64 and 65 respectively are determined in accordance with the particular requirements for designing of the filters. At the open end of the U-type superconductive microstrip resonator 62, the top end of the side of the U-type resonator 62 closer to the input coupling line 611 is aligned With the top portion of input coupling line 611. The same is true for the output coupling line 612 and the U-type resonator 65.

After receiving the filtered signals from the array of resonators, the output coupling line 612 transmits them to output feed-line 602, then the output feed-line 602 transmits the signals to a corresponding processing module.

The above description is directed to another superconductive microstrip filter comprising 4 U type superconductive microstrip resonators according to the present invention. Under the principle for designing a superconductive microstrip filter as mentioned above, more U-type superconductive microstrip resonators can be applied to a filter to obtain a superconductive microstrip filter with more poles on request.

Figure 7:
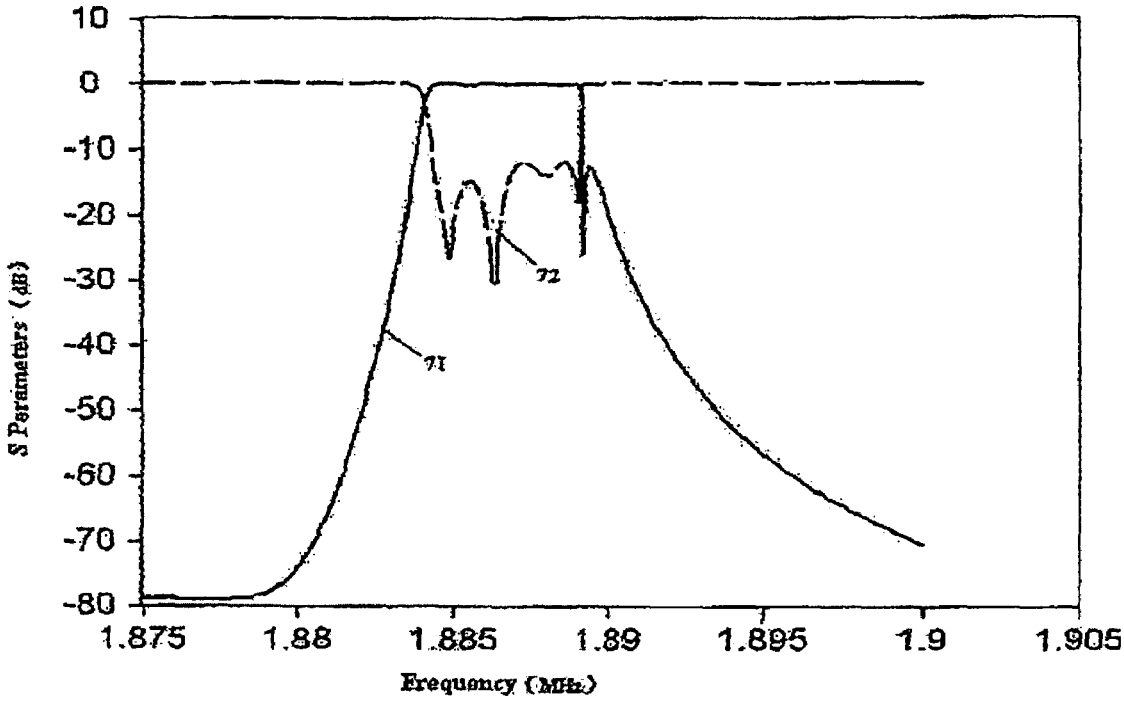
FIG. 7 is a response curve of the superconductive microstrip filter shown in FIG. 6.

FIG. 7 shows a response curve of the superconductive microstrip filter shown in FIG. 6. It can be seen from FIG. 7, the solid curve 71 represents the characteristic curve of transmission loss and the broken curve 72 denotes the one of reflection loss for the superconductive microstrip filter mentioned above. In FIG. 7, the X-axis "Frequency (MHz)" denotes the frequency of the signals in mega-Hertz. The Y-axis "S Parameters" denotes the signal loss value of the microstrip filter. According to this figure, the insertion loss of the superconductive microstrip filter's pass band is 0.29 dB, and the band-edge steep is 27 dB/MHz on low-frequency side and 19 dB/MHz on high-frequency side. In the case of increasing poles of the filter, the band-edge of the superconductive microstrip filter will be steeper, resulting in higher rejection beyond the pass-band.

Because of the smaller dimension of the U-type superconductive microstrip resonator constituting the superconductive microstrip filter of the invention, the filters according to the present invention have better performance of in-band insertion loss, rejection beyond pass-band and band-edge steepness than those open-loop superconductive microstrip filters which are in the same dimension as ones of this invention.

It should be understood that although the invention has been described with respect to specific preferred embodiments, many variations and modifications may become apparent to those skilled in the art. The patent protection scope of the present intention shall be defined by the appended claims and their equivalents.

The invention claimed is:

1. A superconductive microstrip filter, comprising:

an input coupling line, for receiving signals to be filtered and coupling-outputting said signals;

a plurality of U-type superconductive microstrip resonators with the same structure and dimension, for performing filtering process for said signals output by said input coupling line to obtain filtered signals in a corresponding frequency band and then coupling-outputting said filtered signals;

an output coupling line, for coupling-outputting said filtered signals outputted by said plurality of U-type superconductive microstrip resonators;

wherein each of said plurality of U-type superconductive microstrip resonators comprises a superconductive microstrip line bent to a U-type structure having a longer side and a shorter side that are parallel and of different lengths, the superconductive microstrip line having a whole length of half of the wavelength corresponding to the center frequency of said superconductive microstrip filter;

wherein said longer sides and said shorter sides of all of said plurality of U-type superconductive microstrip resonators are parallel, and wherein each neighboring pair in said plurality of U-type superconductive microstrip resonators is arranged axisymmetrically, the U-type superconductive microstrip resonators of each of said neighboring pairs having said longer side closer to a symmetrical axis than said shorter side.

2. The superconductive microstrip filter of claim 1, wherein the interval between each of said plurality of U-type superconductive microstrip resonators is determined in accordance with particular requirements for designing said superconductive microstrip filter.

3. The superconductive microstrip filter of claim 1, wherein the U-type superconductive microstrip resonator which is closest to said input coupling line among said plurality of U-type superconductive microstrip resonators has a top end of said longer side or said shorter side closest to said input coupling line aligned with a top portion of said input coupling line.

4. The superconductive microstrip filter of claim 1, wherein the U-type superconductive microstrip resonator which is closest to said output coupling line among said plurality of U-type superconductive microstrip resonators has a top end of said longer side or said shorter side closest to said output coupling line aligned with a top portion of said output coupling line.

5. A superconductive microstrip filter comprising a plurality of U-type superconductive microstrip resonators, wherein:

each of said plurality of U-type superconductive microstrip resonators comprises a superconductive microstrip line bent to a U-type structure having a longer side and a shorter side that are parallel and of different lengths;

any two neighboring U-type superconductive microstrip resonators in said plurality of U-type superconductive microstrip resonators are arranged axisymmetrically and in parallel with each other; and the superconductive microstrip line of each of said plurality of U-type superconductive microstrip resonators has a length of half of the wavelength corresponding to the center frequency of said superconductive microstrip filter.

6. A superconductive microstrip filter comprising a plurality of U-type superconductive microstrip resonators as recited in claim 5, said superconductive microstrip filter further comprising:

an input coupling line for receiving signals to be filtered and coupling-outputting said signals; and an output coupling line, for coupling-outputting filtered signals outputted by said plurality of U-type superconductive microstrip resonators.

7. A superconductive microstrip filter comprising a plurality of U-type superconductive microstrip resonators as recited in claim 5, wherein said longer side of each of said plurality of U-type microstrip resonators is closer to a symmetrical axis of said axisymmetrical arrangement than said shorter side.

8. A superconductive microstrip filter comprising a plurality of U-type superconductive microstrip resonators as recited in claim 5, wherein said shorter side of each of said plurality of U-type microstrip resonators is closer to a symmetrical axis of said axisymmetrical arrangement than said longer side.

9. A superconductive microstrip filter comprising a plurality of U-type superconductive microstrip resonators as recited in claim 6, wherein the U-type superconductive microstrip resonator which is closest to said output coupling line among said plurality of U-type superconductive microstrip resonators has a top end of said longer side or said shorter side closest to said output coupling line aligned with a top portion of said output coupling line.

* * * * *

UNITED STATES PATENT AND TRADEMARK OFFICE

CERTIFICATE OF CORRECTION

PATENT NO. : 7,532,918 B2
APPLICATION NO. : 10/540332
DATED : May 12, 2009
INVENTOR(S) : Cao et al.

It is certified that error appears in the above-identified patent and that said Letters Patent is hereby corrected as shown below:

On the Title Pg, Item (75) in "Inventors", line 3, delete "Guyoyong Zhang" and insert -- Guoyong Zhang --.

Signed and Sealed this

Eighteenth Day of August, 2009

David J. Kappos

David J. Kappos
*Director of the United States Patent and Trademark Office*